US005626309A

United States Patent [19]

Morgan

[11] Patent Number: 5,626,309

[45] Date of Patent: May 6, 1997

[54] COLLAR ATTACHMENTS FOR A CREEL ADAPTER

[76] Inventor: Arthur C. Morgan, P.O. Box 3187, Cumberland, Md. 21504

[21] Appl. No.: 544,997

[22] Filed: Oct. 30, 1995

[51] Int. Cl.[6] ..... B65H 75/24; B65H 49/02

[52] U.S. Cl. ..... 242/571.4; 242/46.3; 242/130.1; 242/573.7

[58] Field of Search ..... 242/130, 130.1, 242/46.3, 571.4, 571.5, 46.5

[56] References Cited

U.S. PATENT DOCUMENTS

| | | | |
|---|---|---|---|
| 1,635,525 | 7/1927 | Anderson | 242/46.3 |
| 1,916,862 | 7/1933 | Kershaw | 242/130.1 |
| 2,529,351 | 11/1950 | Putnam | 242/46.3 X |
| 2,746,689 | 5/1956 | Berkepeis | 242/46.3 |
| 2,915,260 | 12/1959 | Parrott | 242/130 |
| 3,413,826 | 12/1968 | Abowitz | 242/130 X |
| 4,728,055 | 3/1988 | Wright, Jr. et al. | 242/130 |
| 4,941,622 | 7/1990 | Alexander | 242/46.3 X |
| 5,203,518 | 4/1993 | Morgan | 242/130 |
| 5,297,750 | 3/1994 | Hunt | 242/571.4 X |

*Primary Examiner*—Michael Mansen
*Attorney, Agent, or Firm*—Walter G. Finch

[57] ABSTRACT

An attachment for a creel adaptor. More particularly, this invention relates to a collar for a creel adaptor that has outwardly extending fingers of varying stiffness and multiplicity such that several different material packaging tubes may be used on a single creel base adaptor. In order to make the creel adaptor taught in U.S. Pat. No. 5,203,518 more compatible with packaging tubes which differ in both size and geometric shape, a set of collars having outwardly extending fingers replace the three whiskers disclosed in the U.S. Pat. No. 5,203,518. These collars are placed over the central shaft while the outwardly extending fingers engage the inner periphery of a packaging tube.

4 Claims, 2 Drawing Sheets

COLLAR ATTACHMENTS FOR A CREEL ADAPTER

BACKGROUND OF THE INVENTION

Creel adapter, such as the one patented in U.S. Pat. No. 5,203,518, additionally invented by the present inventor and of which is specifically incorporated by reference herein, have allowed the manufacturing textile industry to significantly reduce the time needed to change exhausted rolls of material. By acting as a transducer between the existing machinery spindles and the spools of material, the creel adapter allows both parallel and tapered material package tubes to be easily mounted and used without expending any additional time in changing non-conforming machinery spindles.

However, it is presently the case that industrial material packaging tubes are not uniformly produced, even within the more specific and common cylindrical and conical species. These species additionally vary in diameter and length, requiring industry again to expend valuable time and effort setting up machinery to accept the next packaging tube, even when using the creel adaptor taught in U.S. Pat. No. 5,203,518.

What is needed is an attachment, or set of attachments, for a creel adaptor that will allow it to accept and secure a multitude of package tubes, without removing the creel adapter itself. The present invention fulfills this and other needs within this industry.

SUMMARY OF THE INVENTION

This invention relates to an attachment for a creel adaptor. More particularly, this invention relates to a collar for a creel adaptor that has outwardly extending fingers of varying stiffness and multiplicity such that several different material packaging tubes may be used on a single creel base adaptor.

In order to make the creel adaptor taught in U.S. Pat. No. 5,203,518 more compatible with packaging tubes which differ in both size and geometric shape, a set of collars having outwardly extending fingers replace the three wiskers disclosed in the U.S. Pat. No. 5,203,518. These collars are placed over the central shaft while the outwardly extending fingers engage the inner periphery of a packaging tube.

Several embodiments of the this invention exist as the purpose of its inception was to allow a creel adaptor to accommodate several different types of packaging tubes. Therefore, the outwardly extending portions of the collars vary in flexibility, length, and multiplicity, ranging from one finger, substantially a solid truncated cone, to eight fingers. Furthermore, these collars can be used singularly or plurally, allowing for varying quantums of friction due to multiples of finger-packaging tube engagement.

It is therefore an object of this invention to provide a collar for a creel adaptor that allow the adaptor to accept and engage a greater spectrum of differing packaging tubes.

It is another object of this invention to allow the creel adaptor to be used in many different industries using some sort of spool/spindle system.

It is a further object of this invention to provide an adjustable means for preventing forward creep of the package roll.

It is yet an additional object of this invention to allow the creel adaptor to accept and secure novel package tube designs without necessitating complete replacement.

It is still another object of this invention to supply the creel adaptor with replaceable finger collars to prevent replacement of the creel adaptor when its whiskers wear and no longer serve their intended purpose.

It is still yet another object of this invention to provide an upgrade to the creel adaptor's existing whisker configuration.

Yet still another object of this invention is to provide the essential package gripping needs in cases where existing hardware are so long as to need to be replaced, because inserted fingers would prevent long pins from going through the interior of the column.

DETAILED DESCRIPTION OF THE DRAWINGS

Figure 1:
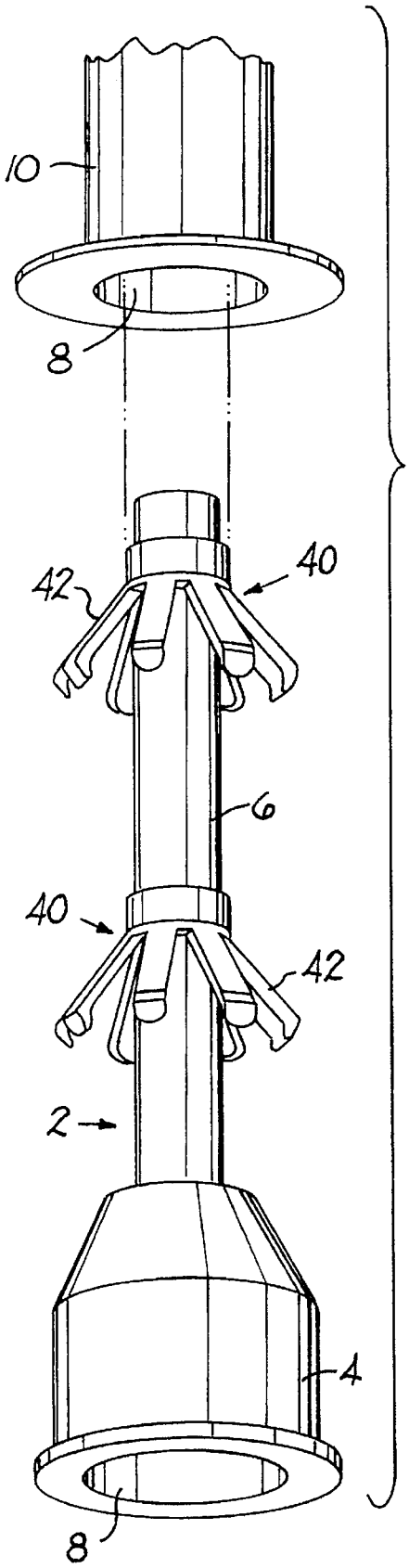
FIG. 1 is a partially exploded view of the creel adaptor with two eight fingered collars and a package tube to be inserted.
Figure 2:
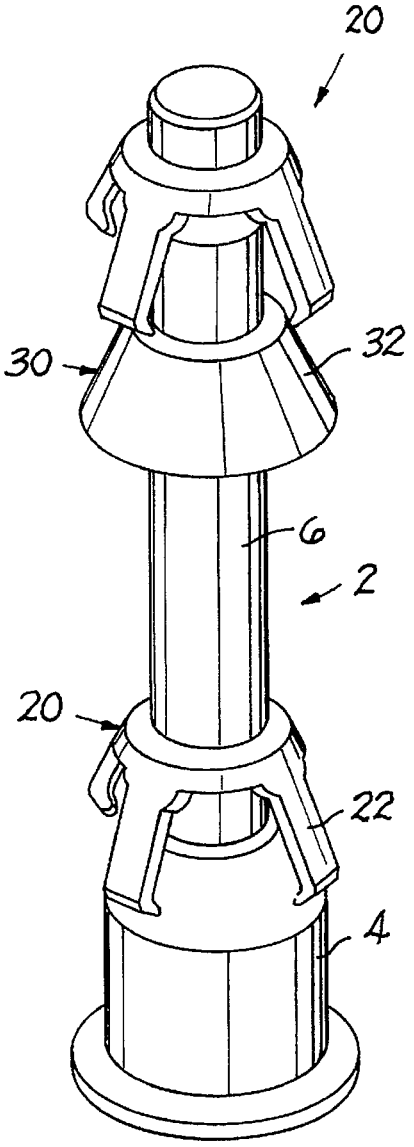
FIG. 2 is a view of a creel adaptor having two four fingered collars and a one fingered collars inserted thereon.

Referring first to FIG. 1 and FIG. 2, a creel adaptor 2 is seen having several attachments inserted thereon. The creel adaptor 2 essentially consists of a base 4 and a smaller diametered elongated central shaft 6, consistent with the specification and claims of U.S. Pat. No. 5,203,518 incorporated by reference herein.

The creel adapter 2 slides onto and attaches to existing machinery at its base 4. The base 4 has an opening 8 designed to accomplish attachment to typical machinery and spindles. The collar attachments 20, and 30, are snugly slid over the central shaft 6 with tolerance that only allow for proper and intended placement. The central shaft 6 is preferably non-metallic and the collar attachments are preferably molded out of a flexible and "rubberized" material, such as synthetic elastomers. These material selections are the preferred as they offer a high coefficient of static friction, especially when the elastomer collar attachments 20, 30 are stressed after insertion within a package tube 10.

FIG. 2 shows a creel adapter having two top mounted, four fingered attachments and a single fingered attachment while FIG. 1 shows a creel adaptor 2 with two eight fingered attachments 40. The arrangement, placement and order of attachments 20, 30, 40 is not predetermined. Various arrangements and/or combinations is an intended feature of this invention thereby allowing versatility to become the biggest asset of the creel adaptor 2.

As the opening 8 of a package tube 10 is inserted onto the central shaft of the creel adaptor 2, the fingers 22, 32, 42 of the collar attachments 20, 30, 40, flex inwardly, each producing equal and opposite forces against the inner diameter of the packaging tube due to their displacement from equilibrium. This equally applied reaction force, combined with the elastomer materials high frictional coefficient, fixes the tube's 10 position against the adapter, automatically centers the tube 10, and additionally prevents unintended rotation or forward creep of the tube 10.

Referring now to FIGS. 3–6, four separate embodiments of this invention are depicted. These, however, are only representative of the most common embodiments of this invention, as the essential components of these collar attachments can be tailored to accommodate each and every particular use and need. While each embodiment typically includes a collar 25, 35, 45, 55 having a appropriately sized opening 26, 36, 46, 56 for receiving a central shaft 6, as well as a top rim 24, 34, 44, 54, and a bottom rim 28, 38, 48, 58, and a plurality of fingers 22, 32, 42, 52. The position of the collar 25, 35, 45, 55, and the multiplicity of the fingers 22, 32, 42, 52 incorporated within each embodiment varies according to individual industrial need. Therefore, several embodiments of the general invention exist of which the most useful or best are disclosed herein.

Figure 3:
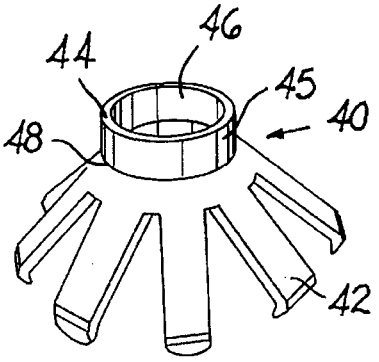
FIG. 3 illustrates perspectively an eight fingered embodiment of the collar attachment.

In FIG. 3, an eight finger embodiment 40 of the collar attachment is shown. The eight equidistant fingers 42 of this embodiment 40 extend outwardly from the bottom rim 48 of the collar 45. The inner diameter of the collar 45 serves as the opening 46 to which a central shaft 6 of a creel adapter 2 is inserted (as in FIGS. 1 and 2).

Figure 4:
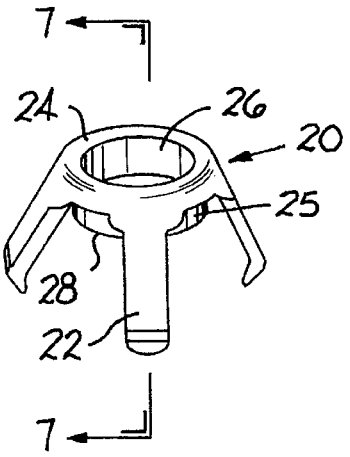
FIG. 4 illustrates perspectively a four fingered, top rim mounted embodiment of the collar attachment.

Since the fingers 42 extend from the bottom rim 48 of the attachment, the fingers 42 are less resistive to being flexed than if the fingers 42 extended outward from the top rim 44 and and therefore had to be flexed downward over the bottom rim 48, as does the four fingered embodiment 20 illustrated in FIG. 4. This gives the user an added rigidity adjustment as the multiplicity of fingers can be fastened to either the top or bottom rim of the attachment.

Referring now to FIG. 4, a four fingered, top rimmed embodiment 20 of the attachment is shown. While this embodiment 20 only has four fingers 22, they extend from the top rim 24 of the collar and are therefore less flexible than bottom rimed fingers of similar multiplicity and material. Again, the collar 25 creates the opening 26 of which a central shaft is inserted.

Figure 5:
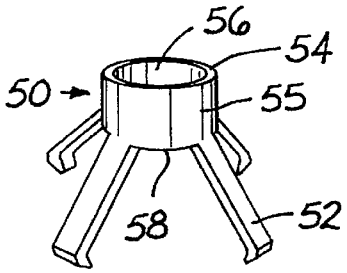
FIG. 5 illustrates perspectively a four fingered, bottom rim mounted embodiment of the collar attachment which is more flexible than the stiffer four fingered embodiment illustrated in FIG. 4.

A four fingered, bottom rim alternative embodiment is depicted in FIG. 5. This embodiment 50 is similar to that of the four fingered embodiment 20 illustrated in FIG. 4 with one major difference. This difference is which rim, the top rim 24 in embodiment 20 and the bottom rim 58 in embodiment 50, the fingers 22, 52 extend from. Since the fingers 52 of embodiment 50 extend from the bottom rim 58 of the collar 53, they are more flexible than the fingers 22 of embodiment 20. This embodiment 50 also attaches itself to the central shaft 6 of a creel adaptor 2 through the opening 56 created by the collar 55.

Figure 6:
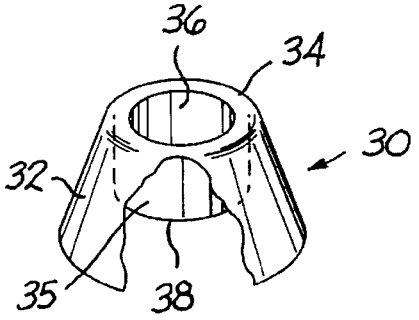
FIG. 6 illustrates perspectively a one fingered embodiment of the collar attachment having the shape of a cone.

FIG. 6 illustrates the one fingered embodiment 30 of this invention. This attachment 30 is conical in form as the one finger 32 actually encloses the entire collar 35. This is the most rigid of all embodiments and can be used separately or in conjunction with other embodiments. When the one fingered embodiment 30 is positioned sufficiently close to the bottom side of another embodiment, 20 for example, as seen in FIG. 1, the fingers 22 of the multi-fingered embodiment 20 contacts the single fingered embodiment 30 and therefore provides a limit on the amount of deflection that is possible. This "piggy-backing" of attachments provides the multi-fingered embodiments with additional frictional forces if, by themselves, slippage is occurring. Furthermore, the "piggy-backing" effect additionally allows a wider range of tube inner diameters that can be accomodated on a single creel pin.

Figure 7:
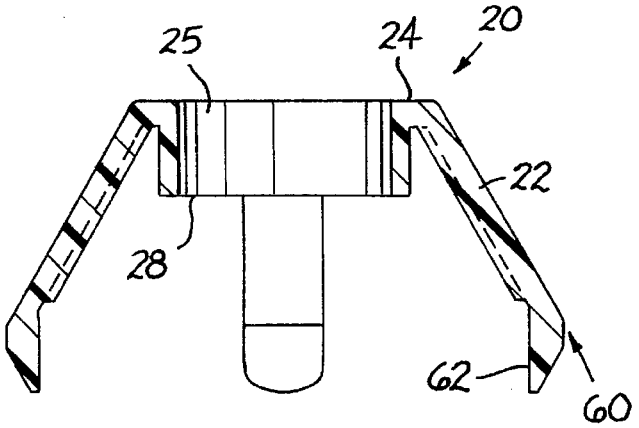
FIG. 7 shows a cross section of the four fingered embodiment of the collar attachment illustrated in FIG. 4.

While the position and multiplicity of fingers 22, 32, 42, 52, varies throughout the different embodiments, the terminating ends of the fingers all have the same substantial configuration. Referring to the cross sectional illustration of embodiment 20 in FIG. 7, the typical ends of all of the fingers 22, 32, 42, 52 are shown. The tips 60 are angled to create a sufficient amount of friction against the packaging tube. Furthermore, the inner angle 62 is created to contact the one fingered embodiment 30, when two collars are "piggy-backed", thereby forcing angle 60 to become parallel and tangent to the inner diameter of the tube, maximizing frictional forces.

It is to be understood that the above is merely four embodiments of this invention and that trivial changes, such as differing finger multiplicity, finger positioning, or changing terminal end angles, are not outside of the contemplation of the inventor nor outside the spirit or scope of the claims.

I claim:

1. A device allowing differing sizes and geometrical shapes of material packaging spools to engage a particular spindle, comprising:

A creel adaptor for slidingly engaging an existing machinery spindle having a base plate, a rear hub connected to said base plate, a conical portion extending longitudinally from said rear hub with a central shaft extending axially therefrom;

a first creel adaptor attachment, having a mounting collar, said collar having an inner surface for frictionally engaging the circumference of said central shaft, said first creel adaptor attachment removably engaging an inner surface of a packaging tube.

2. A device allowing differing sizes and geometrical shapes of material packaging spools to engage a particular spindle as recited in claim 1, further comprising:

a plurality of fingers extending from said mounting collar of said first attachment.

3. A device allowing differing sizes and geometrical shapes of material packaging spools to engage a particular spindle as recited in claim 2, wherein:

each of said plurality of fingers is attached to said mounting collar, and an unattached end of each of said plurality of fingers is angled such that each of said ends is substantially parallel to an inner surface of a packaging tube to be engaged, whereby the frictional forces between said fingers and said packaging tube are maximized.

4. A device allowing differing sizes and geometrical shapes of material packaging spools to engage a particular spindle as recited in claim 3, further comprising:

a second attachment, having a mounting collar, with a plurality of fingers attached thereto, and wherein an unattached end of each of said plurality of fingers is angled such that said unattached ends are substantially parallel to an inner surface of a packaging tube to be engaged, said second attachment circumferentially and axially engaging said central shaft of said creel adaptor, wherein said first and said second attachments engage said packaging tube.

* * * * *